US007896060B2

(12) United States Patent
Ashburn et al.

(10) Patent No.: US 7,896,060 B2
(45) **Date of Patent: *Mar. 1, 2011**

(54) CASTING FURNACE

(75) Inventors: Lennie L. Ashburn, Doylestown, PA (US); Robert W. Fest, Palmyra, NJ (US); John H. Mortimer, Little Egg Harbor Township, NJ (US)

(73) Assignee: PV/T, Inc., Rancocas, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/131,772

(22) Filed: Jun. 2, 2008

(65) Prior Publication Data

US 2008/0223538 A1 Sep. 18, 2008

Related U.S. Application Data

(63) Continuation of application No. 11/399,559, filed on Apr. 6, 2006, now Pat. No. 7,383,873.

(60) Provisional application No. 60/669,480, filed on Apr. 8, 2005.

(51) Int. Cl.
*B22D 27/04* (2006.01)
*B22D 27/15* (2006.01)

(52) U.S. Cl. ..... 164/122.1; 164/258; 164/338.1

(58) Field of Classification Search ..... 164/254–258, 164/338.1, 122.1, 122.2
See application file for complete search history.

(56) References Cited

U.S. PATENT DOCUMENTS

| | | | | |
|---|---|---|---|---|
| 4,750,541 | A * | 6/1988 | Reuter et al. | 164/412 |
| 5,931,214 | A | 8/1999 | Spicer et al. | |
| 6,827,125 | B2 * | 12/2004 | Warren | 164/258 |
| 2004/0055729 | A1 | 3/2004 | Warren | |
| 2004/0187390 | A1 * | 9/2004 | Celani | 49/360 |

FOREIGN PATENT DOCUMENTS

| | | | |
|---|---|---|---|
| JP | 59-76657 | A | 5/1984 |
| JP | 11-114664 | A | 4/1999 |
| JP | 2003-181623 | A | 7/2003 |

* cited by examiner

*Primary Examiner* — Kuang Lin
(74) *Attorney, Agent, or Firm* — Philip O. Post

(57) ABSTRACT

An apparatus and process are provided for casting liquid metals into molds in a casting furnace comprising a controlled environment melt chamber and a mold lock chamber. A mold is supplied to the controlled environment melt chamber for a pour, and removed from the same chamber via a mold lock chamber. A mold transport system moves the mold through the mold lock chamber. The mold transport system comprises a rotary screw drive, a cylinder screw drive, or hydraulic drive located external to the furnace. Alternatively the mold transport system comprises a rack and worm screw drive.

12 Claims, 12 Drawing Sheets

CASTING FURNACE

CROSS REFERENCE TO RELATED APPLICATIONS

This is a continuation application of application Ser. No. 11/399,559, filed Apr. 6, 2006, which application claims the benefit of U.S. Provisional Application No. 60/669,480 filed Apr. 8, 2005, both of which are incorporated herein by reference in their entireties.

FIELD OF THE INVENTION

The present invention relates to casting furnaces wherein a mold is transported to or from a vacuum chamber, or otherwise environmentally controlled chamber, for casting with a liquid material, such as liquid metal.

BACKGROUND OF THE INVENTION

A vacuum casting furnace is used to cast a liquid material, such as a molten metal alloy, into a mold. While referred to as a "vacuum" furnace, the furnace may cast in other controlled environments, such as an argon atmosphere. Generally a metal charge is placed in a crucible located in the controlled environment melt chamber and melted into a liquid by using a suitable energy source, such as electric induction power. A mold is transported to and from the melt chamber via a chamber serving as a controlled environment lock since it is generally desirous to maintain the melt chamber at vacuum while molds transition to and from the melt chamber.

There are methods to raise and lower a mold through a mold lock chamber to deliver the mold to the melt chamber, and to remove a filled mold from the melt chamber, respectively, wherein components of the mold transport system are located in the mold lock chamber. However the mold lock chamber presents a severely adverse environment for components of the mold transport system. When metal is poured, molten metal splatter can fall into the mold lock chamber and damage or degrade these components. Occasionally a mold will crack while in the melt chamber, or mold lock chamber, and metal leaking out of the mold can severely damage these components. Additionally the environment of the mold lock chamber is generally hot and contains particulate, which results in decreased life and increased maintenance of the components of the mold transport system.

One object of the present invention is to provide a mold transport system with components that are located outside of the casting furnace.

Another object of the present invention is to provide a mold transport system with components that are easily accessible and maintainable, and that will have a relatively long life even if installed in the casting furnace.

BRIEF SUMMARY OF THE INVENTION

In one aspect, the present invention is an apparatus for, and method of, producing a casting in a casting furnace having a controlled environment melt chamber in which a liquid metal is poured into a mold that is transported to the controlled environment melt chamber via a mold lock chamber by a mold transport system. The mold transport system comprises a rotary screw drive having a rotary screw and linear motion driven shaft element attached to the rotary screw. The rotary screw drive is located external to the casting furnace and on the side of the controlled environment melt chamber in one example of the invention. A drive means is provided to rotate the rotary screw. A lift shaft is attached to a linear motion guide element. The first end of the lift shaft is attached to the linear motion driven shaft element, and a support arm is attached at its first end near to the second end of lift shaft. A mold support structure, upon which a mold can be placed, is attached to the second end of the support arm. The linear motion driven shaft element moves along the longitudinal vertical axis of the rotary screw when the screw is rotated, which also raises or lowers the mold seated on the mold support structure. The lift shaft and first end of the support arm are disposed in a lift shaft housing that is connected to the mold lock chamber. The lift shaft housing may be attached to a wall of the mold lock chamber, or to a door located in a wall of the mold lock chamber. When so located in the door, the lift shaft can be detachably connected to the external linear motion driven shaft element so that when the door is opened the lift shaft, support arm, mold support structure, and a mold seated on the mold support structure, will protrude out of the mold lock chamber. The rotary screw drive may be a planetary rotary screw drive. In other examples of the invention, the rotary screw may be replaced by a hydraulic actuator.

In another aspect, the present invention is an apparatus for, and method of, producing a casting in a casting furnace having a controlled environment melt chamber in which a liquid metal is poured into a mold that is transported to the controlled environment melt chamber via a mold lock chamber by a mold transport system. The mold transport system comprises a cylinder screw drive having a hollow cylindrical screw with an interior threaded surface, and an externally threaded lift screw inserted in the cylindrical screw. A drive is provided to rotate the cylindrical screw, which causes the lift screw to move along the longitudinal axis of the cylindrical screw, whereby one end of the lift screw moves further into or out of a lift screw housing attached to the mold lock chamber.

A support arm is attached at its first end to the end of the lift screw in the lift screw housing. A mold support structure, upon which a mold can be placed, is attached to the second end of the support arm. The lift screw moves linearly along the longitudinal axis of the cylindrical screw when the cylindrical screw is rotated, which also raises or lowers the mold seated on the mold support structure. The lift screw housing may be attached to a wall of the mold lock chamber or a door located in a wall of the mold lock chamber. When so located in the door, when the door is opened the support arm, mold support structure, and a mold seated on the mold support structure, will protrude out of the mold lock chamber.

In another aspect, the present invention is an apparatus for, and method of, producing a casting in a casting furnace having a controlled environment melt chamber in which a liquid metal is poured into a mold that is transported to the controlled environment melt chamber via a mold lock chamber by a mold transport system. The mold transport system comprises a rack and worm screw drive wherein the teeth of the worm screw engage the teeth of the rack so that the worm screw travels linearly along the length of the rack when the worm screw is rotated. The worm screw is suitably attached to the first end of a support arm. A mold support structure, upon which a mold can be placed, is attached to the second end of the support arm so that the support arm, mold support structure, and mold seated on the mold support structure travel linearly along the length of the rack along with the worm screw. The rack and worm screw drive may be contained in a drive housing attached to a wall of the mold lock chamber, or to a door located in a wall of the mold lock chamber. When so located in the door, when the door is opened, the support arm, mold support structure, and a mold seated on the mold support structure, will protrude out of the mold lock chamber.

These and other aspects of the invention are set forth in this specification and the appended claims.

BRIEF DESCRIPTION OF THE DRAWINGS

For the purpose of illustrating the invention, there is shown in the drawings a form that is presently preferred; it being understood, however, that this invention is not limited to the precise arrangements and instrumentalities shown.

FIG. 1(*b*) is a front elevational view with partial cross section of the example of the casting furnace in FIG. 1(*a*).

FIG. 1(*c*) is a cross sectional view of the example of the induction casting furnace in FIG. 1(*a*) through line A-A with additional illustration of furnace doors in the opened position.

FIG. 1(*d*) is a detail of one means of connection between the linear lift drive element and lift shaft used in the casting furnace shown in FIG. 1(*a*) through FIG. 1(*c*).

FIG. 2(*b*) is a front elevational view with partial cross section of the example of the casting furnace in FIG. 2(*a*).

FIG. 2(*c*) is a cross sectional view of the example of the induction casting furnace in FIG. 2(*a*) through line B-B with additional illustration of doors in the opened positions.

FIG. 3(*b*) is a cross sectional view of the example of the induction casting furnace in FIG. 3(*a*) through line C-C with additional illustration of doors in the opened positions.

FIG. 4(*b*) is an elevational view of the rack and worm screw drive used with the example of the casting furnace in FIG. 4(*a*).

FIG. 4(*c*) is a cross sectional view of the example of the casting furnace in FIG. 4(*a*) through line D-D with additional illustration of a mold lock chamber door in the opened position.

DETAILED DESCRIPTION OF THE INVENTION

Figure 1A:
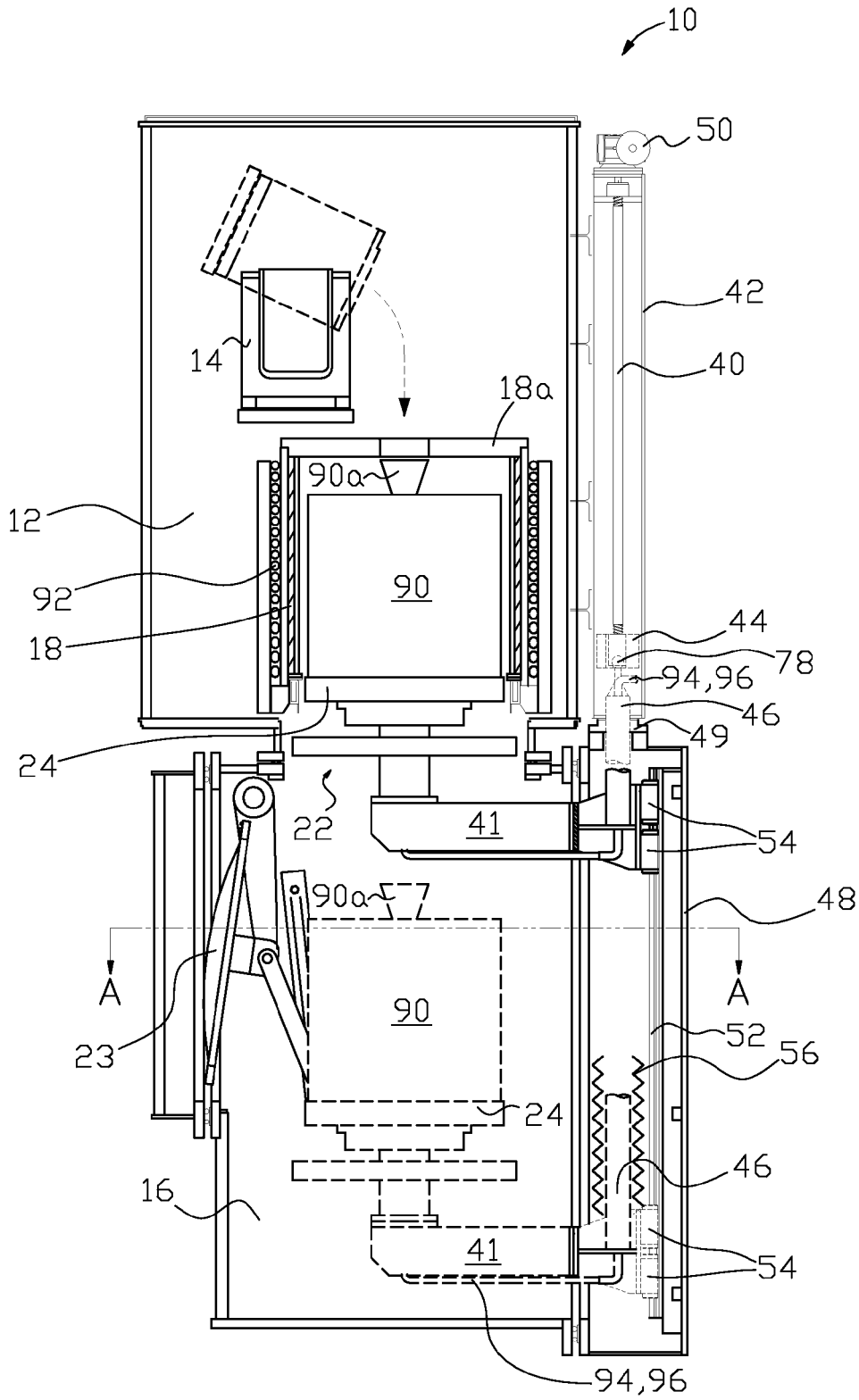
FIG. 1(*a*) is a cross sectional side elevational view of one example of the casting furnace of the present invention.
Figure 1B:
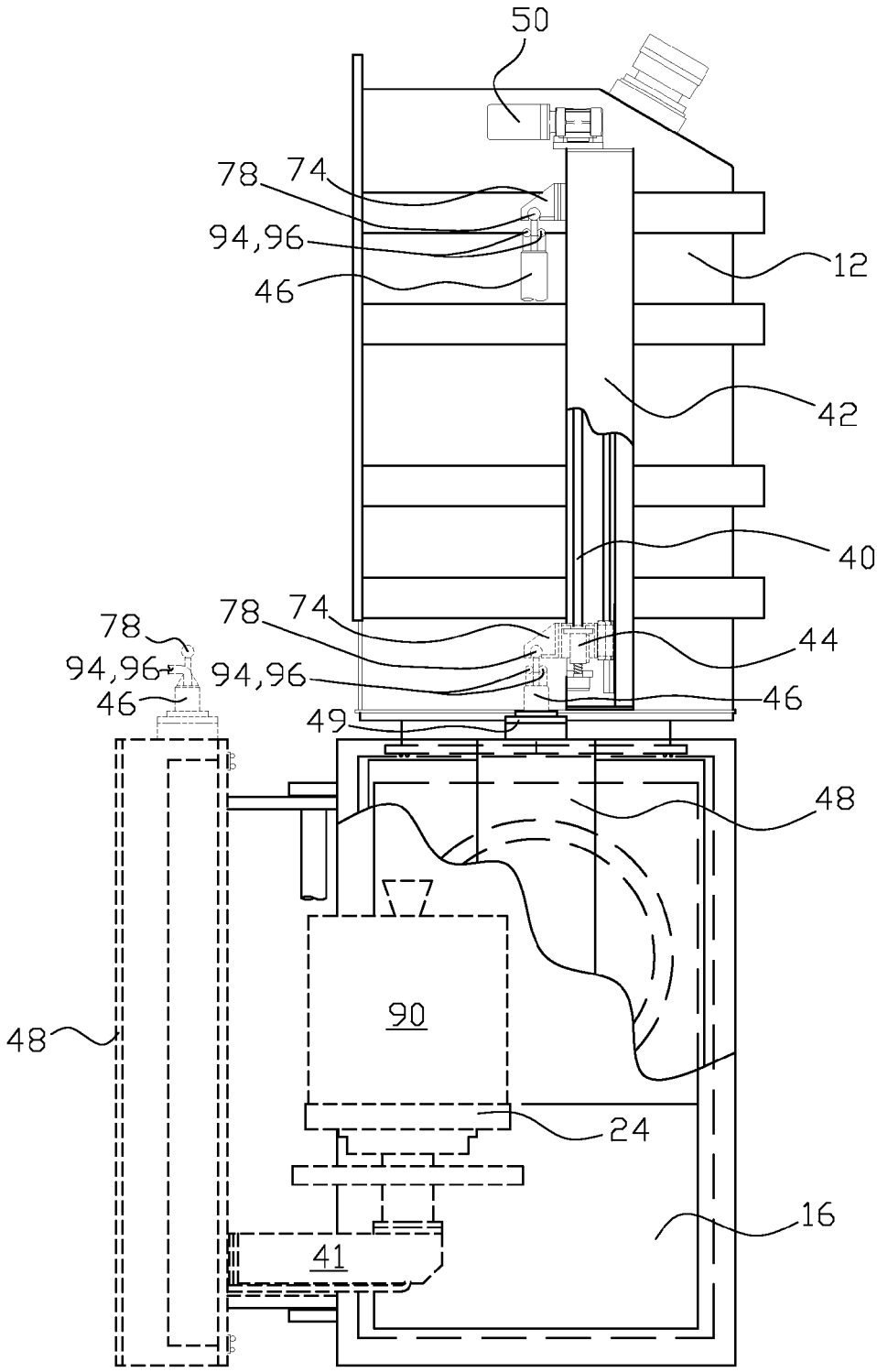
Figure 1C:
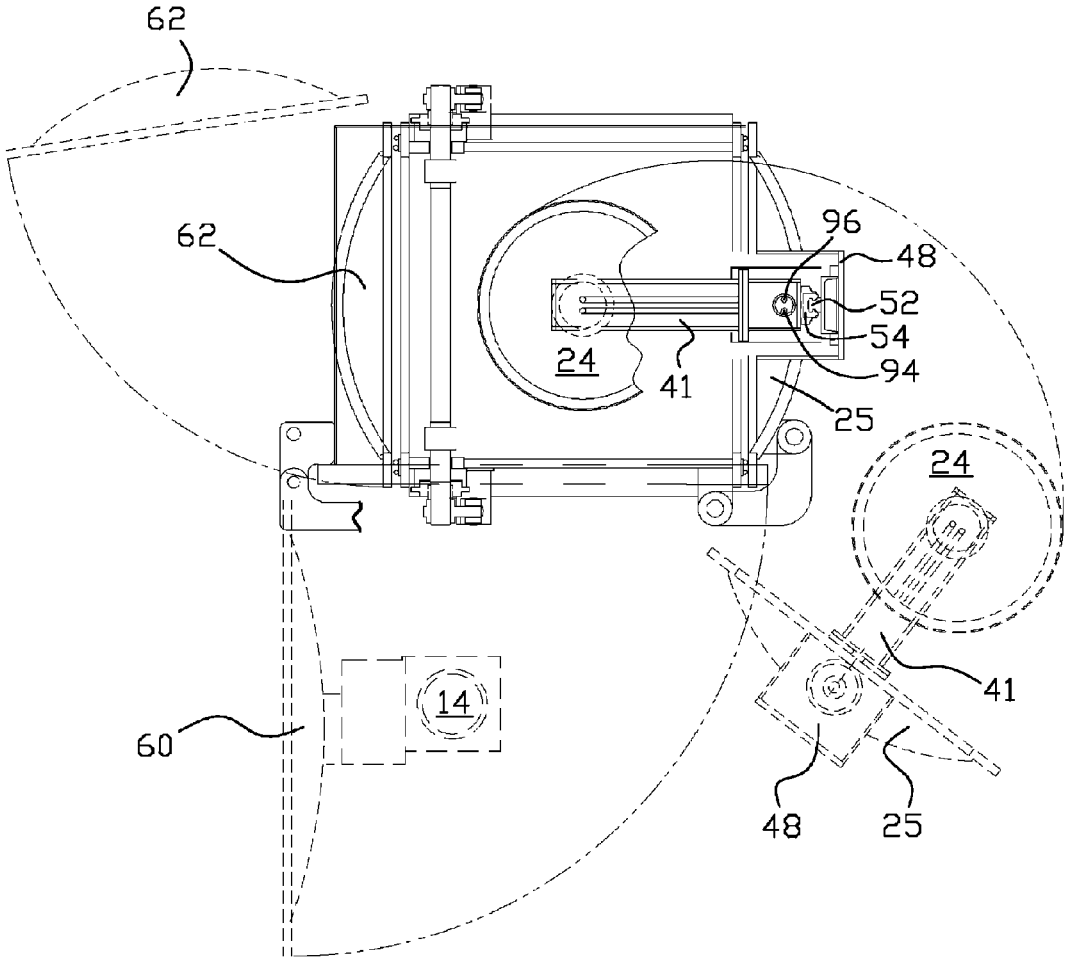
Figure 1D:
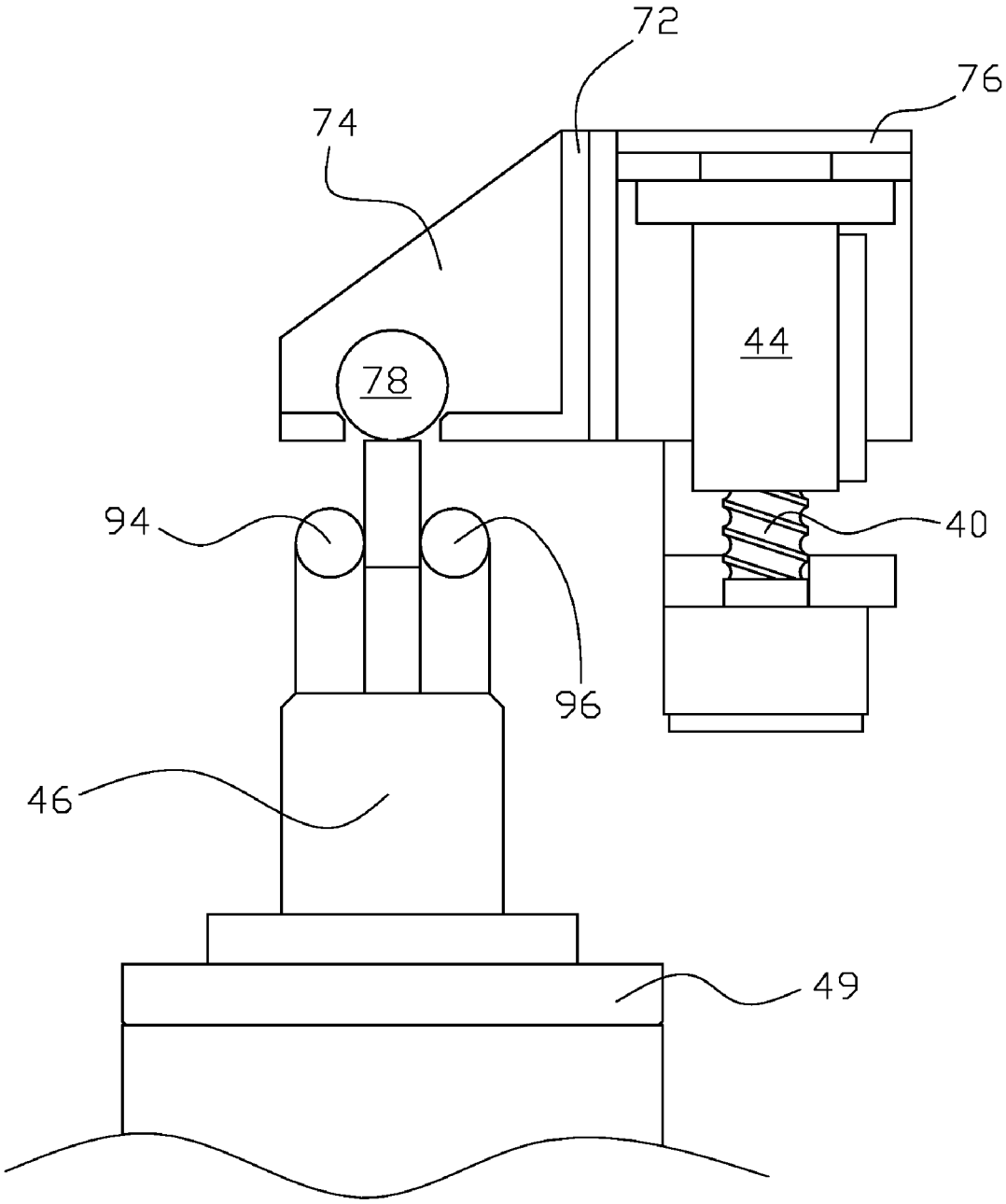

Referring now to the drawings, wherein like numerals indicate like elements, there is shown in FIG. 1(*a*) through FIG. 1(*d*) one example of the casting furnace 10 of the present invention. A controlled environment melt chamber, also referred to as melt chamber 12, contains crucible 14 (shown in solid lines in upright position and dashed lines in pouring position) for holding a liquid metal. The controlled environment may be a contained atmosphere, such as an argon atmosphere pumped into the chamber, or a vacuum. For convenience the controlled environment melt chamber is further referred to as a melt chamber and the process as a vacuum pour. Metal may be melted in crucible 14 by electric induction or other suitable heating means, or liquid metal may be poured into the crucible from an external source before the chamber is sealed for a pour. Mold 90 is inserted into melt chamber 12 by vertically lifting the mold through the mold lock chamber, which is positioned below the melt chamber. In FIG. 1(*a*) mold 90 is shown in solid lines in the melt chamber and dashed lines in a second position in mold lock chamber 16.

Suitable heating means may optionally be provided to keep the mold at a desired temperature during the pouring process and/or the withdrawal of the mold from the melt chamber. For example electric induction power may be used by surrounding mold 90 with susceptor material 18 while it is in the melt chamber. Induction coil 92 surrounds the susceptor material and an ac current flowing through the coil inductively heats the susceptor material. The induction coil is shown in cross section FIG. 1(*a*) as a series of vertical circles on either side of the susceptor material. Heat generated in the susceptor heats the mold by convection. When inserted into the melt chamber for a pour, the opening in sprue 90*a* of the mold aligns with the opening in cover 18*a* that is placed over the mold so that liquid metal can be poured into the mold from the crucible. Means can be provided for rotation and translation, if necessary, of the crucible during a pour.

In other examples of the invention the mold heating means may not be required. In this case the mold will be lifted to enable a pour of liquid metal into the mold. In this case the mold may not necessarily be raised completely out of the mold lock chamber into the melt chamber, but sufficiently raised to allow pouring in the mold. Further in other examples of the invention the mold heating means may be provided near the top of the mold lock chamber so that only the sprue of the mold protrudes into the melt chamber.

In one non-limiting example of the invention, metal charge is placed in crucible 14. A vacuum is drawn in melt chamber 12. Sealable opening 22 provides a means for entry and exit of a mold into the melt chamber. Hatch or valve 23, shown in the position when sealable opening 22 is opened, pivots and raises to seal around the perimeter of opening 22 when a mold is not in the melt chamber. A suitable power drive can be provided to operate valve 23, such as hydraulic drive 20 (illustrated in FIG. 2(*a*)), which can be mounted on the outer surface of a wall of the mold lock chamber.

Mold lock chamber 16 can also be maintained at vacuum when opening 22 is opened. Door 25 (best seen in FIG. 1(*c*)) in one wall of the mold lock chamber pivots open to allow entry or removal of a mold from the mold lock chamber as further described below and is sealed closed when the mold lock chamber is at vacuum.

Referring to FIG. 1(*a*) a rotary screw drive is located in drive housing 42. The drive housing is located external to the casting furnace, and in this example of the invention, on the side of the melt chamber, which is above the mold lock chamber. Locating the drive in this position physically isolates it from the environment of the mold lock chamber and allows convenient access to the drive, for example, for maintenance. In this non-limiting example of the invention the drive housing is attached to the side of the melt chamber. Connecting means are provided to connect roller 44, which serves as a linear motion driven shaft element, to the top of lift shaft 46. Lift shaft 46 moves vertically in and out of lift housing 48 through sealing element 49. In this non-limiting example of the invention, the lift housing is attached to the exterior of door 25. The bottom of lift shaft 46 is suitably attached to one end of structural support arm 41 upon which mold support structure 24 is mounted. Rotary drive means, such as electric motor 50, is used to rotate threaded rotary screw 40, which, in turn, causes roller 44 to raise or lower around screw 40, depending upon the rotational direction of the screw, since the roller is threadably connected to screw 40. Other suitable drive means, such as a hydraulic motor, may be used. Rotary screw 40 is only shown partially threaded along its axial length for convenience in FIG. 1(*a*). Generally rotary screw 40 is threaded substantially along its entire axial length. Since roller 44 is attached to the lift shaft, raising or lowering of the roller will also raise or lower lift shaft 46, support arm 41, mold support structure 24 and mold 90 sitting on the mold support structure. As most clearly illustrated in FIG. 1(*b*) drive housing 42 and enclosed rotary screw drive components are vertically offset from lift housing 48 and enclosed components (shown partially in solid lines in the closed door position and in dashed lines in the door opened position).

In FIG. 1(*a*) mold 90 and lift elements, such as mold support structure 24, support arm 41, lift shaft 46, roller 44, and linear slide bearings 54 are shown in dashed lines when the mold support structure is in its lowest position in the mold lock chamber, and in solid lines when the mold support structure is in its highest position with mold 90 seated on the support structure and in position for a pour. Linear slide rail 52 is attached to the back interior wall of lift housing 48. One or more linear slide bearings 54, which are attached to the lift shaft, are slidably attached to the linear slide rail. This connection provides one non-limiting means for keeping vertical movement (raising and lowering) of the mold in alignment relative to the melt and mold lock chambers. Bellows boot 56 may be optionally provided around the lift shaft.

Optional openings for access to various components of the furnace may be disposed around the sides of the furnace. Referring to FIG. 1(*c*), as previously mentioned, door 25 is provided in a first wall of the mold lock chamber to provide a means for insertion or removal of a mold from the chamber. Melt chamber hatch or door 60 provides closure for an opening located in a wall of the melt chamber that is above a second wall of the mold lock chamber. Optionally crucible 14 may be attached to door 60 so that the crucible protrudes from the melt chamber when the door is opened. Rear access hatch or door 62 provides closure for an opening located in a third wall of the mold lock chamber, which is the side of the mold lock chamber opposite door 25. In FIG. 1(*c*) the doors and associated components are shown in solid lines in the closed position and in dashed lines in the opened position.

FIG. 1(*d*) illustrates the details of one non-limiting example of providing the connecting means between roller 44 and lift shaft 46 wherein the connection automatically uncouples when door 25 pivots to the opened position. Angle element 72 is attached to gusset backing plate 74. The angle element and backing plate are attached directly or indirectly to plate 76 sitting on top of roller 44 and around rotary screw 40 so that when the roller is raised or lowered, as described above, the angle element and backing plate will also be raised or lower. An opening or slot in the horizontal region of angle element 72 provides an opening for insertion of rod or ball 78, which is attached directly or indirectly to the top of lift shaft 46. With this arrangement, when door 25 is in the closed position, ball 78 is retained in the slot in the angle element causing the lift shaft to raise and lower with movement of roller 44. When door 25 is swung open, ball 78 exits the slot in the angle element to disconnect the lift shaft from the roller disposed in the drive housing mounted external to the mold lock chamber. Consequently the lift shaft, support arm 41, mold support structure 24 and mold 90 seated on the support structure (if any) swing out and away from the furnace when door 25 is opened. This facilitates maintenance and replacement of these items that are directly or indirectly mounted to door 25, and also facilitates placing a mold on the support structure, or taking a mold off of the support structure.

A chill plate may be provided as an interface between the bottom of the mold and mold support structure 24 upon which the mold sits. The chill plate is typically used to keep the bottom of the mold at a relatively low temperature to assist in solidification of a liquid metal poured into the mold. Optionally, for example, tubing 94 and 96 for supply and return of a cooling or heating medium, such as water, from the exterior of the furnace to internal passages in the chill plate may be routed through a vacuum seal at the top of the lift shaft and through the interior of the lift shaft when the lift shaft has a hollow interior. Other components, such as thermocouples, that require tubing or wiring from the exterior of the furnace to components on the mold support structure may also be made through the interior of the lift shaft.

Figure 2A:
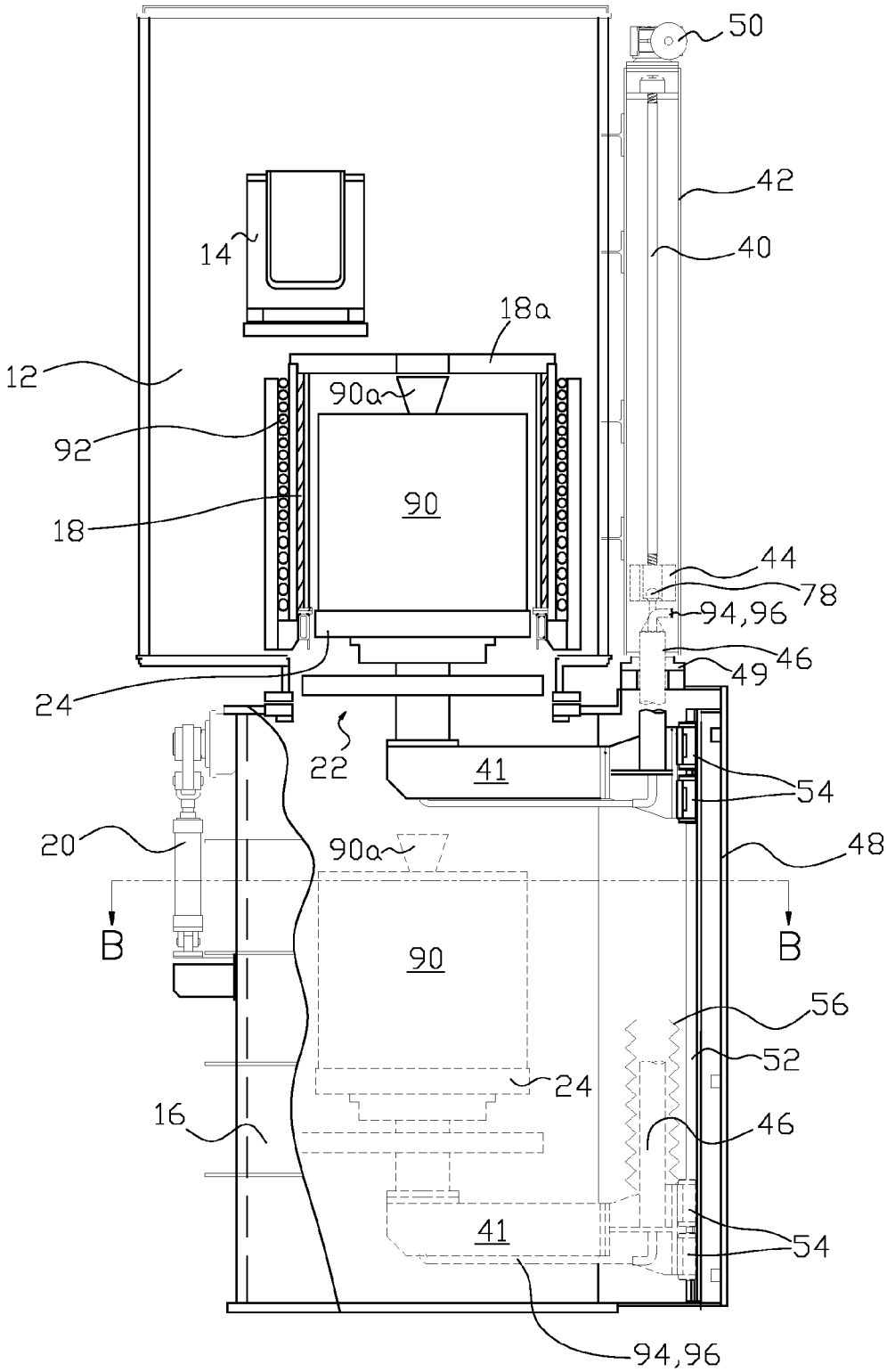
FIG. 2(*a*) is a side elevational view with partial cross section of another example of the casting furnace of the present invention.
Figure 2B:
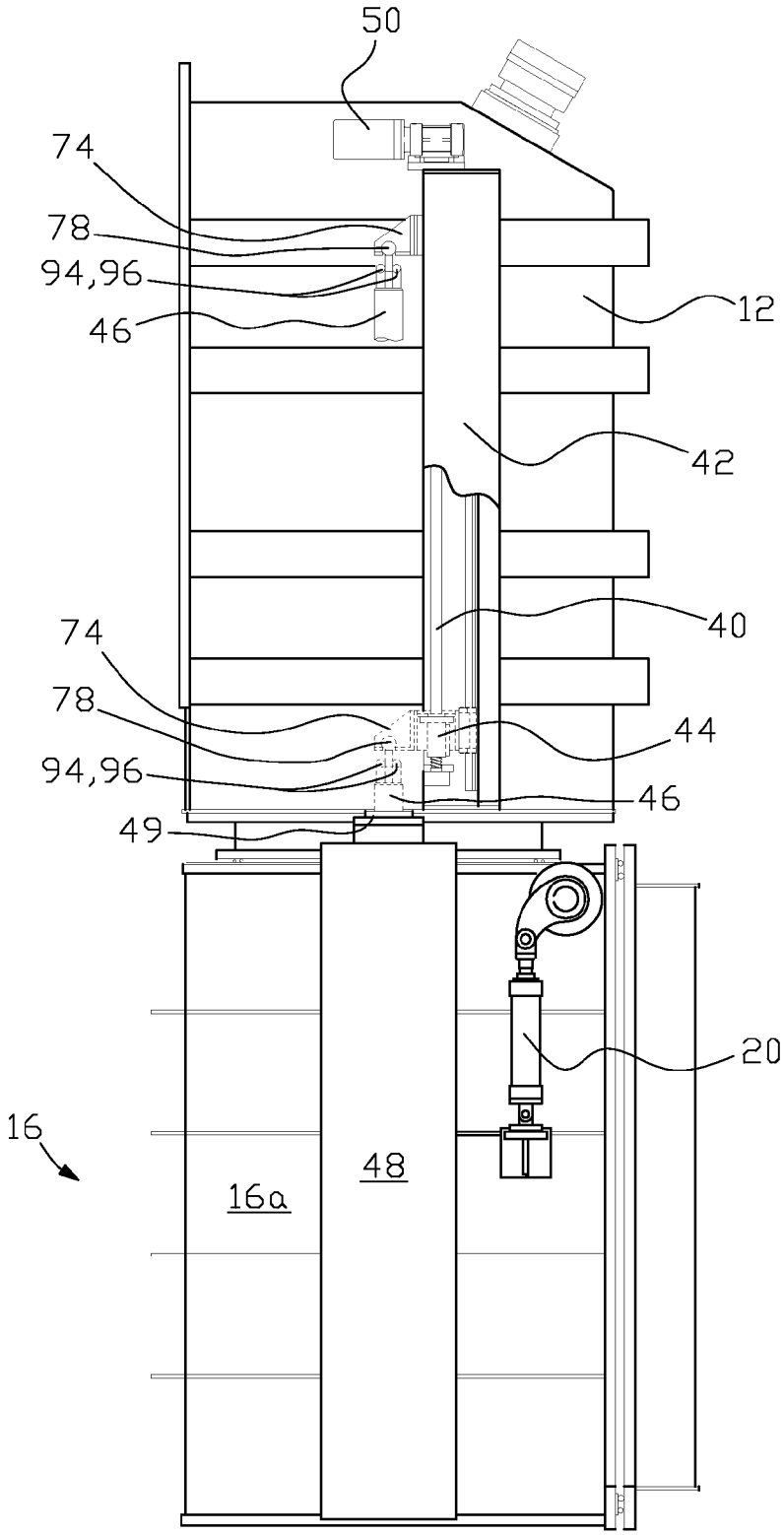
Figure 2C:
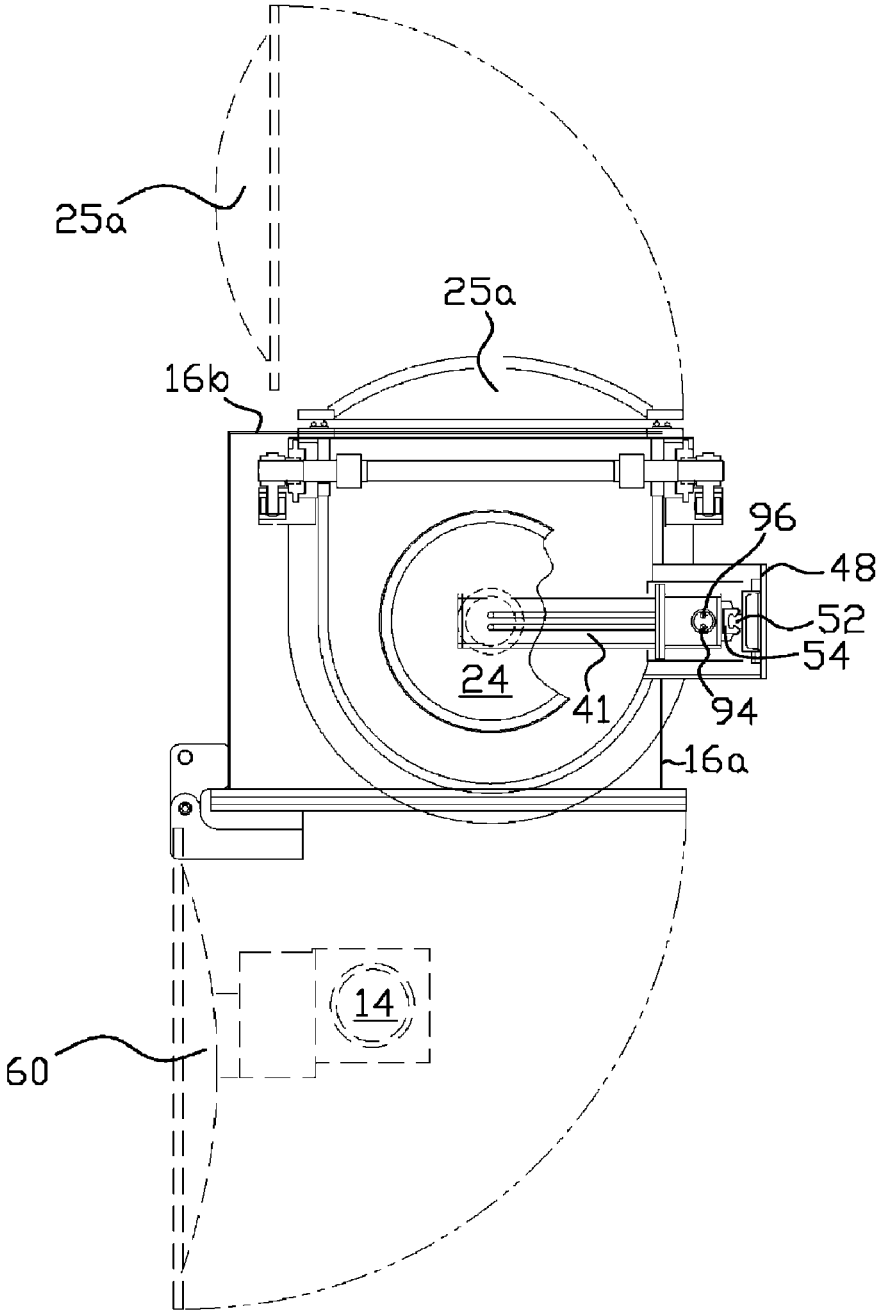

There is shown in FIG. 2(*a*), FIG. 2(*b*) and FIG. 2(*c*) another example of the casting furnace of the present invention. This example is generally similar to the example illustrated in FIG. 1(*a*) through FIG. 1(*d*) except that lift shaft 46, support arm 41, mold support structure 24 and associated components are in lift housing 48 that is attached to wall 16*a* of the mold lock chamber and not to a door as in the example above. Molds are loaded onto, or taken off of, the mold support structure through an opening in another wall of the mold lock chamber, such as wall 16*b* (FIG. 2(*c*)). Door 25*a* provides a means for closing the opening to seal the mold lock chamber.

By way of example and not limitation, the rotary screw drive used with the embodiments of the invention illustrated in FIG. 1(*a*) through FIG. 1(*d*), and FIG. 2(*a*) through FIG. 2(*c*) may be a planetary roller screw, such as but not limited to, PRS Series Planetary Roller Screws available from Exlar, Corp., Chanhassen, Minn. In these embodiments, a plurality of roller screws are provided between one or more rollers 44 (or nuts) and rotary screw 40. The one or more rollers are suitably connected to the top of lift shaft 46.

In the above examples of the invention, drive housing 42 is attached to a wall of the melt chamber. In other examples of the invention the drive housing may be attached directly to the top of lift housing 48 or structural elements separate from the casting furnace. Alternatively, in other examples of the invention, the lift drive housing 42 and associated components may be inverted from the position shown in FIG. 1(*a*) and mounted on the mold lock door. In this arrangement, the top of lift shaft 46 would be suitably attached to rollers 44 (or nuts) on the inverted rotary screw 40 so that when the rotary drive means rotates screw 40, which, in turn, causes roller 44 to raise or lower around the screw, and the lift shaft, support arm, mold support structure, and mold sitting on the mold support structure will also be raised or lowered in similar fashion as that in the above examples of the invention.

While the above examples of the invention illustrate one rotary screw drive, two or more rotary screw drives and lift shafts may be used in the invention. For example, a pair of drives and lift shafts may be located on opposing sides of the furnace to lift both ends of the support arm.

In the above examples of the invention, the rotary screw drive may be replaced by a linear hydraulic actuator. The output rod or shaft of the hydraulic actuator would be attached to the first end of the lift shaft, in place of the linear motion shaft driven element used in the rotary screw drive. In this arrangement, the linear hydraulic actuator is located external to the casting furnace. Motion of the output shaft causes a mold seated on the mold support structure in the mold lock chamber to be raised or lowered since, similar to the arrangements with the rotary screw drive, the output shaft is attached to the lift shaft, which in turn, is attached to the support arm, mold support structure.

Figure 3A:
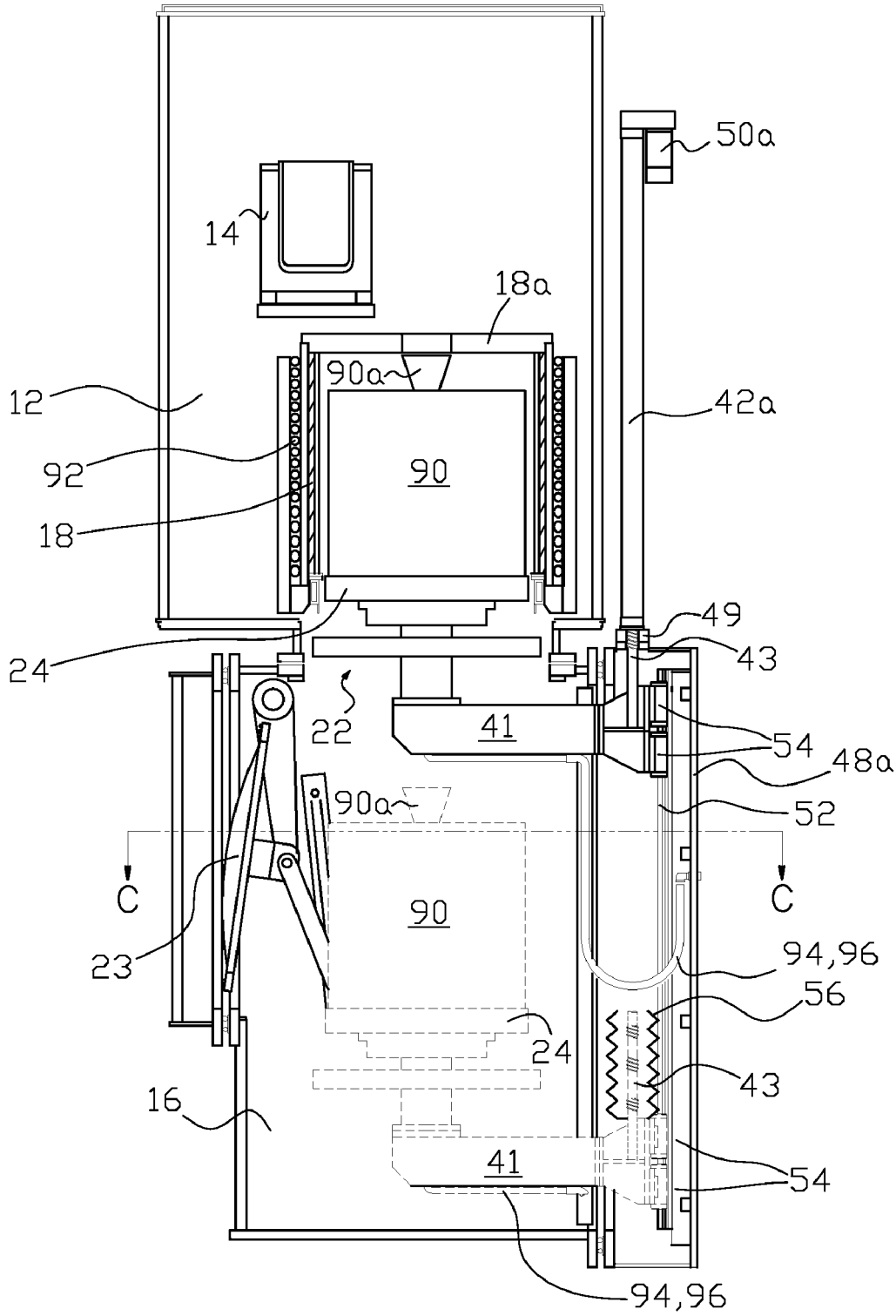
FIG. 3(*a*) is a cross sectional side elevational view of another example of the casting furnace of the present invention.
Figure 3B:
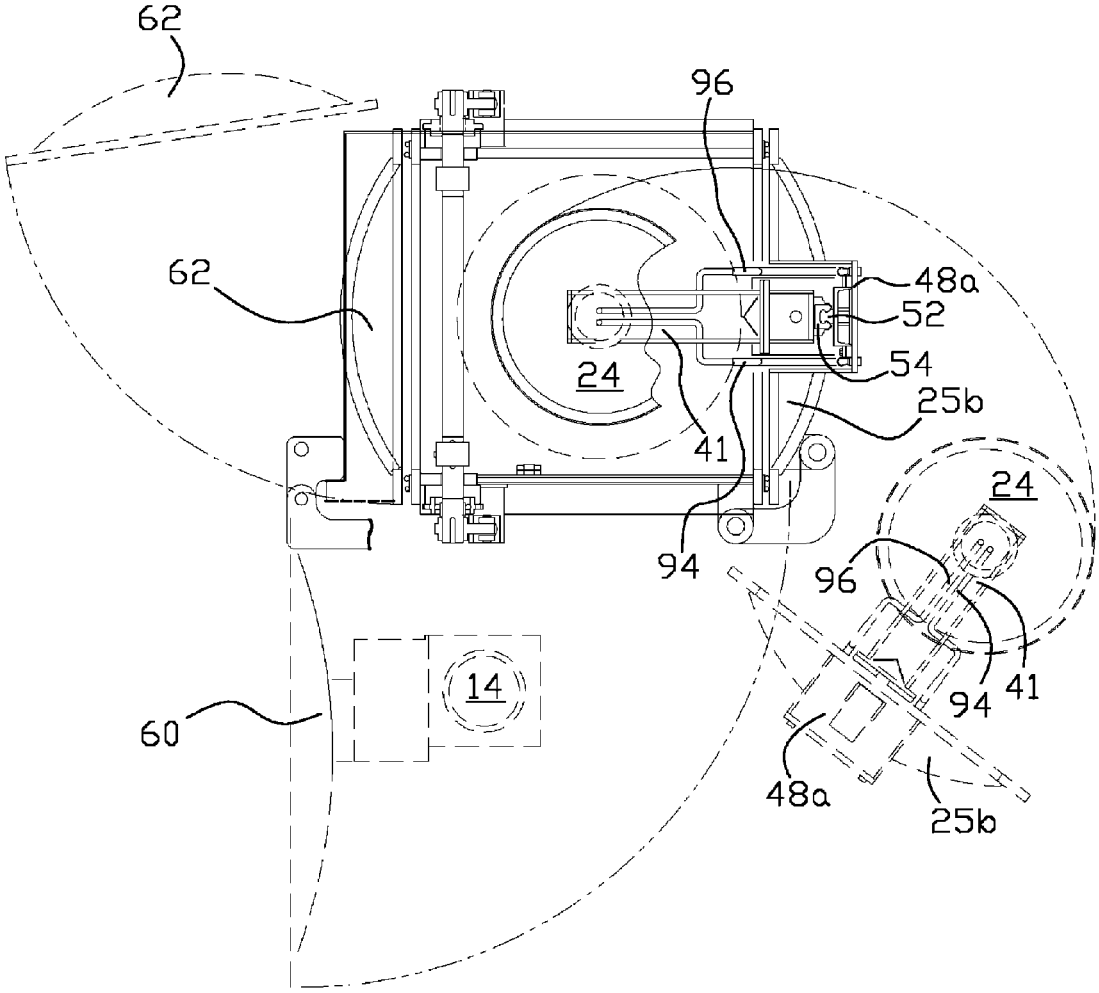

There is shown in FIG. 3(*a*) and FIG. 3(*b*) another example of the casting furnace of the present invention. In this arrangement cylinder screw drive housing 42*a* is provided external to the casting furnace. Generally the cylinder screw drive comprises a hollow cylindrical element, wherein the interior surface of the hollow cylindrical element is threaded, and an externally threaded screw. The externally threaded screw is threadably connected to the interior threaded surface of the cylindrical element, either directly or indirectly, for example, via worm screws as described above. Rotating the cylindrical element will cause the threaded screw to either protrude from or recede into the hollow cylindrical element. The cylindrical element is housed in drive housing 42*a* in FIG. 3(*a*). Suitable drive means, such as electric motor 50*a* is used to rotate the cylindrical element. Depending upon the direction of rotation externally threaded screw 43 either moves in or out of the cylindrical element in the drive housing and, correspondingly, out or in of lift screw housing 48*a*. Externally threaded screw 43 is only shown partially threaded along its axial length for convenience in the figures. Generally the externally threaded screw is threaded substantially along its entire axial length. Drive housing 42*a* and/or threaded screw 43 penetrate the lift screw housing through suitable seal 49. One end of threaded screw 43 is suitably connected to an end of structural support arm 41 upon which mold support structure 24 is mounted. Consequently rotating the cylindrical element of the cylinder screw drive will result in the support arm, mold support structure, and mold 90 seated on the mold support structure to raise or lower within the mold lock chamber.

Features of the inventions illustrated in FIG. 1(*a*) through FIG. 1(*c*) and described above, may be used in other examples of the invention wherein the rotary screw drive is replaced with the cylinder screw drive. In the cylinder screw drive embodiments, the end of the threaded screw is connected directly to the support arm. Consequently there is no need for connecting means illustrated by example in FIG. 1(*d*) for the rotary screw drive. In FIG. 3(*a*) and FIG. 3(*b*) cylinder screw drive housing 42*a* is mounted directly to the top of lift screw drive housing 48*a* and the lift screw drive housing is attached to door 25*b*. In other arrangements of the invention the lift screw drive housing and enclosed components may be attached to a sidewall of the mold lock chamber.

Further while the examples of the invention illustrated in FIG. 3(*a*) and FIG. 3(*b*) illustrate one cylinder screw drive, two or more cylinder screw drives may be used in the invention. For example, a pair of cylinder screw drives may be located on opposing sides of the furnace to lift both ends of the support arm.

Figure 4A:
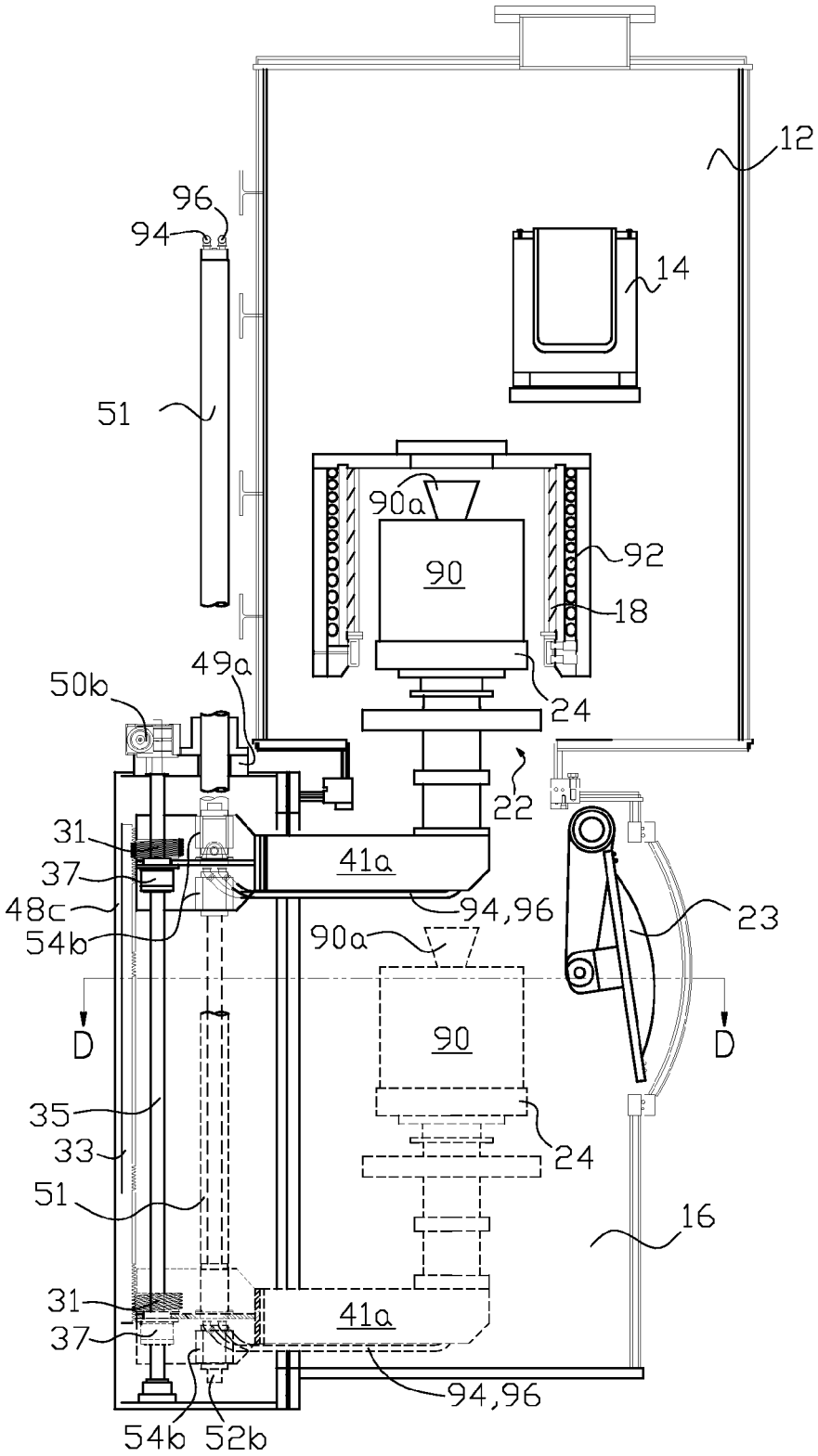
FIG. 4(*a*) is a cross sectional side elevational view of another example of the casting furnace of the present invention.
Figure 4B:
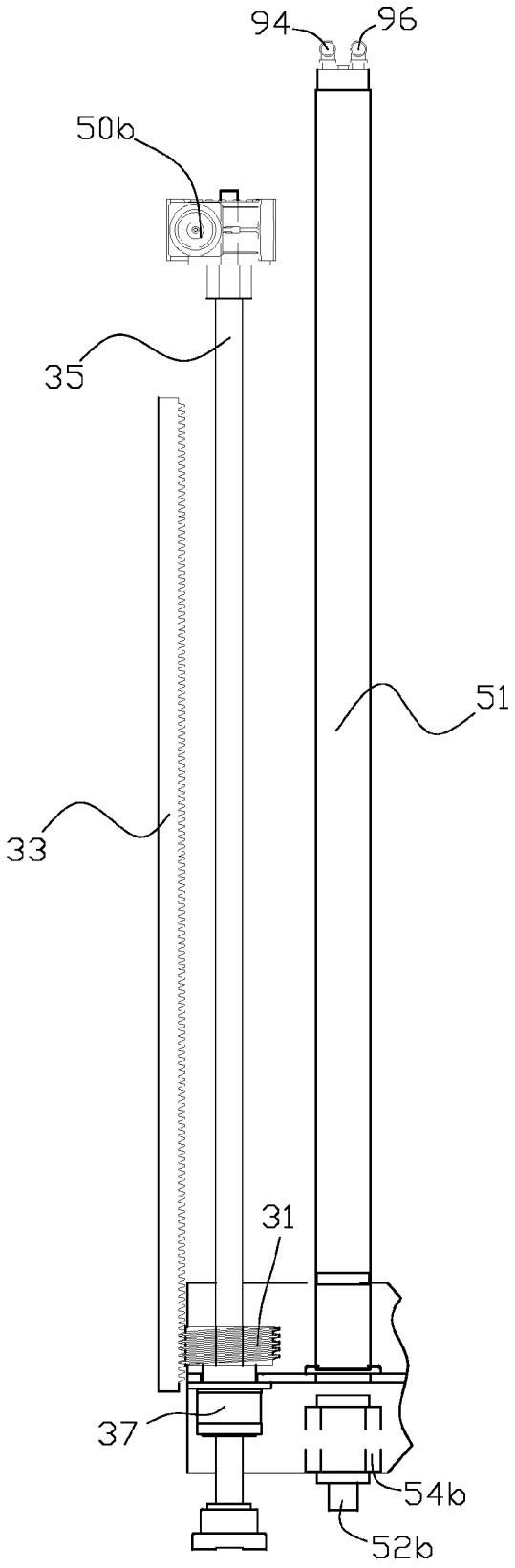
Figure 4C:
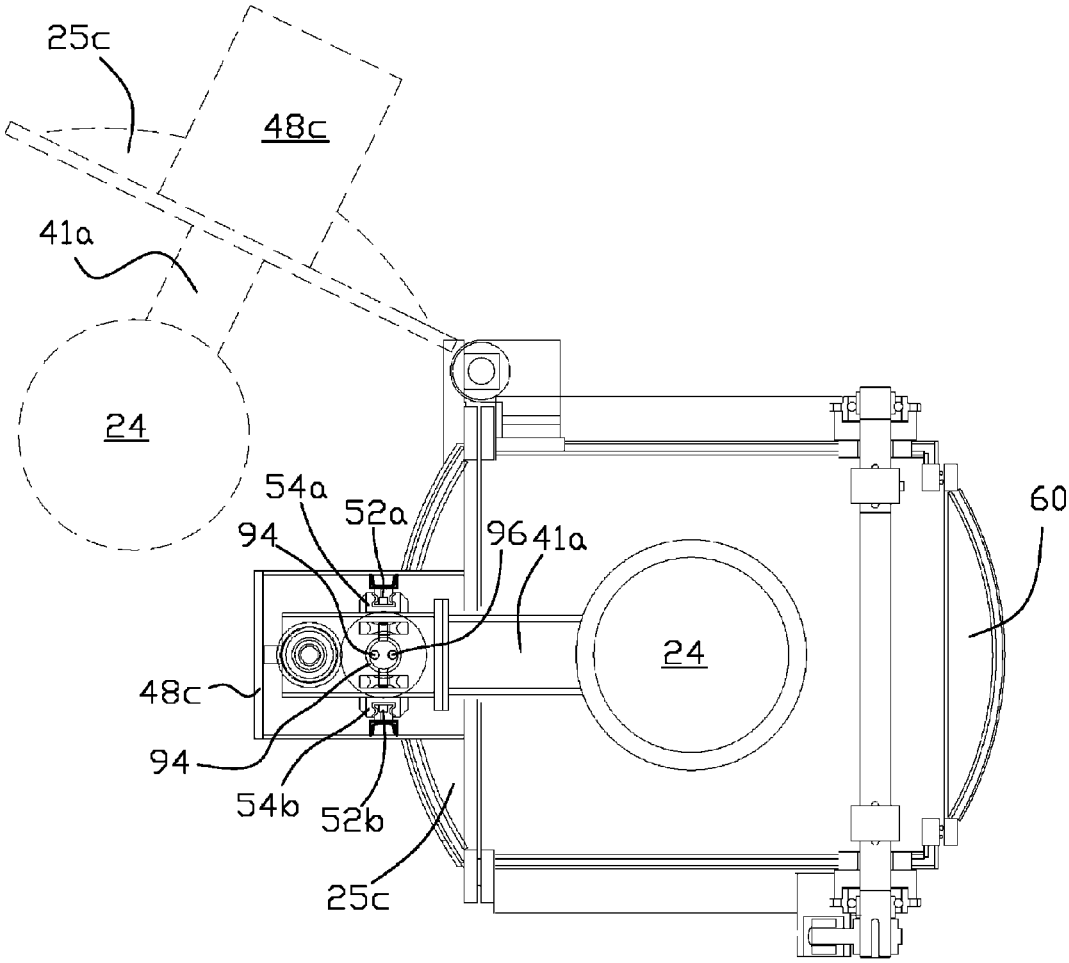

There is shown in FIG. 4(*a*) through FIG. 4(*c*) another example of the casting furnace of the present invention. In FIG. 4(*a*) selected components are shown in two positions, namely, the position wherein mold 90 is supplied to melt chamber 12, and the position wherein mold 90 is at its lowest position in the mold lock chamber. Components in the latter position are illustrated in dashed lines. In this arrangement a rack and worm screw drive is used to raise or lower mold 90 in mold lock chamber 16. The drive can be located in drive housing 48*c*, which is connected to the mold lock chamber. The teeth of worm screw 31 mesh with the teeth of rack 33. The worm screw is suitably attached to shaft 35 so that when the shaft rotates the worm screw moves up or down on the shaft depending upon the direction of rotation. Drive 50*b* provides suitable drive means for rotating shaft 35. One end of support arm 41*a* is attached to the worm screw so that it is raised or lowered as the worm screw moves up or down on the shaft. Since the support arm is attached to mold lift support structure 24 and mold 90 seated on the mold support structure, the motion of the worm screw will cause a mold to be lifted through the mold lock chamber for pour of a liquid metal into the mold from crucible 14 in the melt chamber and lowered through the mold lock chamber after the pour has been completed.

In one non-limiting example of the invention a rotary ball spline, type LTR, available from THK America, Inc., Schaumburg, Ill., is used for shaft 35. The type LTR rotary ball spline comprises a spline shaft and nut 37. The nut has inner and outer cylindrical components. The inner cylindrical component is attached to the spline shaft so that it rotates with rotation of the spline shaft and is free to move along the axial length of the shaft. The outer cylindrical component is attached to the inner cylindrical component by ball bearings so that the outer cylindrical component will move along the axial length of the shaft with the inner component, but without rotating about the shaft. In the present example of the invention the worm screw is attached to the inner cylindrical component and the end of support arm 41*a* is connected to the outer cylindrical component.

Means can be provided to keep the support arm, mold support structure and any mold sitting on the support structure in alignment as these components are raised and lowered through the mold lock chamber. One example of such means is best illustrated in FIG. 4(*c*). Linear slide rails 52*a* and 52*b* are suitably attached to opposing sides of drive housing 48*c*. One or more linear slide bearings 54*a* and 54*b* are attached to opposing sides of support arm 41*a* and slidably attached to the linear slide rails.

Optionally conduit 51 may be provided to contain tubing 94 and 96 and other components as previously described above for other examples of the invention. One end of the conduit terminates at support arm 41*a* while the other end terminates outside of the furnace. The conduit penetrates the top of the drive housing through suitable seal 49*a* and protrudes from, or recedes into the mold lock chamber as the support arm is raised or lowered, respectively.

Drive housing 48*c* may be connected directly to a sidewall of the mold lock chamber or to a door provided over an opening in a sidewall. FIG. 4(*c*) illustrates an arrangement wherein the drive housing is connected to door 25*c*. In FIG. 4(*c*) the door, with associated drive housing, is shown in solid lines in the closed position and in dashed lines in the opened position. Optional melt chamber hatch or door 60 provides closure for an opening located in a wall of the melt chamber.

Further while the examples of the invention illustrated in FIG. 4(*a*) through FIG. 4(*c*) illustrate one rack and worm screw drive, two or more rack and worm screw drives may be used in the invention. For example, a pair of drives may be located on opposing sides of the furnace to lift both ends of the support arm.

In any examples of the invention the controlled environment melt chamber and mold lock chamber may be of modular design so that a mold lock chamber may be used with more than one controlled environment melt chamber by providing suitable interface connecting means between the controlled environment melt chamber and the mold lock chamber. For example the mold lock chamber may be provided with wheels as a means for moving the mold lock chamber between controlled environment melt chambers.

The above examples of the invention have been provided merely for the purpose of explanation and are in no way to be construed as limiting of the present invention. While the invention has been described with reference to various embodiments, the words used herein are words of description and illustration, rather than words of limitations. Although the invention has been described herein with reference to particular means, materials and embodiments, the invention is not intended to be limited to the particulars disclosed herein; rather, the invention extends to all functionally equivalent structures, methods and uses, such as are within the scope of the appended claims. Those skilled in the art, having the benefit of the teachings of this specification, may effect numerous modifications thereto, and changes may be made without departing from the scope and spirit of the invention in its aspects.

The invention claimed is:

1. A casting furnace comprising a controlled environment melt chamber and a mold lock chamber for transport of a mold to the controlled environment melt chamber for pouring of a liquid metal into the mold, the improvement comprising:

a rotary screw drive located externally from and adjacent to a side of the casting furnace, the rotary screw drive comprising a rotary screw, a linear motion driven shaft element connected to the rotary screw, and a drive means, the linear motion driven shaft element moving linearly along the longitudinal axis of the rotary screw when the rotary screw is rotated by the drive means;

a lift shaft disposed within a lift shaft housing on a side of the mold lock chamber, the first end of the lift shaft attached to the linear motion driven shaft element, the lift shaft penetrating through a seal in the lift shaft housing;

a support arm attached near to the second end of the lift shaft, the support arm protruding into the mold lock chamber; and a mold support structure attached to the support arm, the mold support structure providing means for seating of the mold, whereby moving the linear motion driven shaft element linearly along the longitudinal axis of the rotary screw causes the mold seated on the mold support structure in the mold lock chamber to be raised to the controlled environment melt chamber or lowered from the controlled environment melt chamber.

2. The casting furnace of claim 1 wherein the rotary screw drive is attached to the exterior side of the controlled environment melt chamber.

3. The casting furnace of claim 1 wherein the linear motion driven shaft element is detachably connected to the lift shaft to permit moving the lift shaft, support arm and mold support structure independent from the movement of the linear motion driven shaft element.

4. The casting furnace of claim 1 wherein the rotary screw drive comprises a planetary rotary screw drive.

5. A casting furnace comprising a controlled environment melt chamber and a mold lock chamber for transport of a mold to the controlled environment melt chamber for pouring of a liquid metal into the mold, the improvement comprising:

a cylinder screw drive disposed external to and adjacent to a side of the casting furnace, the cylinder screw drive comprising a hollow cylindrical screw having an interior threaded surface, an externally threaded lift screw inserted in the cylindrical screw, the lift screw moving linearly along the longitudinal axis of the cylindrical screw when the cylindrical screw is rotated by a drive means, the lift screw extending into a lift screw housing by a suitable seal;

a support arm attached to the end of lift screw extending into the lift screw housing, the support arm protruding into the mold lock chamber; and a mold support structure attached to the support arm, the mold support structure providing means for seating of the mold, whereby moving the lift screw linearly along the longitudinal axis of the cylinder screw causes the mold seated on the mold support structure in the mold lock chamber to be raised to the controlled environment melt chamber or lowered from the controlled environment melt chamber.

6. The casting furnace of claim 5 wherein the cylinder screw drive is attached to the exterior side of the mold lock chamber.

7. A method of casting from a casting furnace comprising a controlled environment melt chamber and a mold lock chamber, the method comprising the steps of transporting a mold to the controlled environment melt chamber via the mold lock chamber, pouring a liquid metal into the mold, and transporting the mold from the controlled environment melt chamber via the mold lock chamber, the improvement comprising the steps of:

providing a hollow cylindrical screw external to and adjacent to a side of the casting furnace, providing an externally threaded lift screw in the hollow cylindrical screw, the lift screw moving linearly along the longitudinal axis of the cylindrical screw in a lift screw housing when the cylindrical screw is rotated, the lift screw housing located external to the casting furnace;

connecting the first end of a support arm to the end of the lift screw in the lift screw housing, the support arm protruding into the mold lock chamber;

connecting a mold support structure near to a second end of the support arm; and rotating the cylindrical screw to raise or lower a mold seated on the mold support structure.

8. A casting furnace comprising a controlled environment melt chamber and a mold lock chamber for transport of a mold to the controlled environment melt chamber for pouring of a liquid metal into the mold, the improvement comprising:

a linear hydraulic actuator located externally from and adjacent to a side of the casting furnace, the linear hydraulic actuator having an output shaft moving linearly along the longitudinal axis of the linear hydraulic actuator responsive to a hydraulic drive means;

a lift shaft disposed within a lift shaft housing on the side of the mold lock chamber, the first end of the lift shaft attached to the end of the output shaft, the lift shaft penetrating into the lift shaft housing;

a support arm attached near to the second end of the lift shaft, the support arm protruding into the mold lock chamber; and a mold support structure attached to the support arm, the mold support structure providing means for seating of the mold, whereby moving the output shaft linearly along the longitudinal axis of the linear hydraulic actuator causes the mold seated on the mold support structure in the mold lock chamber to be raised to the controlled environment melt chamber or lowered from the controlled environment melt chamber.

9. The casting furnace of claim 8 wherein the linear hydraulic actuator is attached to the exterior side of the controlled environment melt chamber.

10. The casting furnace of claim 8 wherein the linear hydraulic actuator is detachably connected to the lift shaft to permit moving the lift shaft, support arm and mold support structure independent from the movement of the linear motion driven shaft element.

11. A method of casting from a casting furnace comprising a controlled environment melt chamber and a mold lock chamber, the method comprising the steps of transporting a mold to the controlled environment melt chamber via the mold lock chamber, pouring a liquid metal into the mold, and transporting the mold from the controlled environment melt chamber via the mold lock chamber, the improvement comprising the steps of:

providing a rotary screw drive in a drive housing located external to and adjacent to a side of the casting furnace, the drive housing containing a rotary screw, connecting a linear motion driven shaft element to the rotary screw, the linear motion driven shaft element moving linearly along the longitudinal axis of the rotary screw when the rotary screw is rotated;

connecting the first end of a lift shaft to the linear motion driven shaft element, the lift shaft moving linearly parallel to the longitudinal axis of the rotary screw in a lift shaft housing when the rotary screw is rotated, the lift shaft housing located external to the casting furnace;

connecting the first end of a support arm to the end of the lift shaft in the lift shaft housing, the support arm protruding into the mold lock chamber;

connecting a mold support structure near to the second end of the support arm; and rotating the rotary screw to raise or lower a mold seated on the mold support structure.

12. A method of casting from a casting furnace comprising a controlled environment melt chamber and a mold lock chamber, the method comprising the steps of transporting a mold to the controlled environment melt chamber via the mold lock chamber, pouring a liquid metal into the mold, and transporting the mold from the controlled environment melt chamber via the mold lock chamber, the improvement comprising the steps of:

providing a linear hydraulic actuator external to and adjacent to a side of the casting furnace, the linear hydraulic actuator having an output shaft moving linearly along the longitudinal axis of the linear hydraulic actuator responsive to a hydraulic drive means;

connecting the first end of a lift shaft to the end of the output shaft, the lift shaft penetrating into a lift shaft housing on the side of the mold lock chamber, the lift shaft moving linearly parallel to the longitudinal axis of the linear hydraulic actuator when the output shaft moves linearly along the longitudinal axis of the linear hydraulic actuator;

connecting the first end of a support arm to the end of the lift shaft in the lift shaft housing, the support arm protruding into the mold lock chamber;

connecting a mold support structure near to the second end of the support arm; and moving the output shaft to raise or lower a mold seated on the mold support structure.

* * * * *